US006509556B2

(12) United States Patent
Kim

(10) Patent No.: US 6,509,556 B2
(45) Date of Patent: Jan. 21, 2003

(54) STRUCTURE OF VENTILATION MOTOR ASSEMBLY IN MICROWAVE OVEN

(75) Inventor: Su Hwan Kim, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/933,009

(22) Filed: Aug. 21, 2001

(65) Prior Publication Data

US 2002/0084268 A1 Jul. 4, 2002

(30) Foreign Application Priority Data

Dec. 30, 2000 (KR) ..... 2000-87362

(51) Int. Cl.[7] ..... H05B 6/80

(52) U.S. Cl. ..... 219/757; 219/681; 126/21 A; 126/299 R

(58) Field of Search ..... 219/757, 756, 219/681, 400; 126/21 A, 198, 299 R, 299 D

(56) References Cited

U.S. PATENT DOCUMENTS 3,680,328 A * 8/1972 McCarty ..... 415/406
4,111,000 A * 9/1978 Sakazume et al. ..... 62/262
4,786,774 A * 11/1988 Kaminaka ..... 219/757
5,886,330 A * 3/1999 Kang et al. ..... 219/757
5,927,391 A * 7/1999 Chung ..... 415/176
5,951,907 A * 9/1999 Kang ..... 219/757
6,239,419 B1 * 5/2001 Kim ..... 219/757

* cited by examiner

*Primary Examiner*—Philip H. Leung
(74) *Attorney, Agent, or Firm*—Fleshner & Kim, LLP

(57) ABSTRACT

Structure of a ventilation motor assembly in a microwave oven including a ventilation motor having first and second shafts fitted in opposite directions, a sirocco fan interlocked with the first shaft for drawing air in a direction of the first shaft and discharging in a direction perpendicular to the first shaft, and a radial fan interlocked with the second shaft for drawing air in a direction perpendicular to the second shaft and discharging in a direction of the second shaft, thereby permitting to vary an air suction/discharge structure by forming air flows in left and right sides of the ventilation motor.

19 Claims, 2 Drawing Sheets

STRUCTURE OF VENTILATION MOTOR ASSEMBLY IN MICROWAVE OVEN

BACKGROUND OF THE INVENTION

1. Field of the Invention

The present invention relates to a microwave oven, and, more particularly, to an improved structure of a ventilation motor assembly fitted above a cavity of a microwave oven for discharging, not only heat, smoke, smell from an inside of the microwave oven, but also heat, smoke, smell from a gas oven range provided below the microwave oven.

2. Background of the Related Art

The microwave oven is a cooker having a magnetron for generating, and directing a microwave to cooking material, to cause molecular movement therein, that generates a heat for the cooking material. Recently, a microwave oven is developed, which has a function of the cooker itself, as well as a function of ventilator that removes heat, gas, and smell for food from a gas range or gas oven range. Such a microwave oven is in general placed over the gas oven range, to call such a microwave oven as OTR (Over-the-Range) type microwave oven. A ventilation motor assembly of the related art OTR type microwave oven will be explained with reference to FIGS. 1 and 2. FIG. 1 illustrates a perspective view showing a system of related art ventilation motor and sirocco fan.

Referring to the drawing, the ventilation motor 2 is provided between one pair of supports 4, for forming an air flow. The ventilation motor 2 has one pair of sirocco fans 12 and 24 shaft connected thereto on both sides thereof. The sirocco fan shaft connected on a left side thereof is called as a left fan 14, and the sirocco fan shaft connected on a right side thereof is called as a right fan 24. There is a fan housing 12 or 22 enclosing each of the fans 14 or 24. There is an air outlet 12*b* or 22*b* and an air inlet 12*a* and 22*a* in each of the fan housings 12 or 22 in a direction of the shaft. The air inlet 12*a* or 22*a* is formed in a side of each of the fan housings 12 or 22, and the air outlet 12*b* or 22*b* is formed in an outer circumference of the fan housing 12 or 22 in a direction perpendicular to the shaft direction, such that an air flow through the air inlet 12*a* or 22*a* and the air flow through the air outlet 12*b* or 22*b* are perpendicular to each other.

In the meantime, the fan housings 12 and 22 enclosing the left and right fans 14 and 24 are rotatable centered on the vent motor 2, to change a direction of the air outlet according to rotation of the fan housings 12 and 22. Arrows and symbols 'f' on the drawing represent directions of air flows.

FIG. 2 illustrates a perspective view of a microwave oven showing a related art ventilation motor fitted thereto.

Referring to FIG. 2, there is an electric fitting room 36 at a side of a cavity 32 for accommodating food to be cooked therein, and an exhaust gas passage in rear of the electric fitting room 36 for guiding exhaust gas from a gas oven range under the microwave oven to above the cavity 32. There is an air duct 34 over the cavity 32, and the ventilation motor 2 fitted in rear of the air duct 34. The fan housings 12 and 22 on both sides of the ventilation motor 2 are fitted in a lateral direction of the microwave oven. That is, the one pair of air inlets 12*a* and 22*a* in the fan housings face left and right sides of the microwave oven, and the one pair of the air outlet 12*b* and 22*b* in the fan housings 12 and 22 are provided to face an upper part of the microwave oven.

The work of the related art ventilation motor assembly in a microwave oven will be explained. At first, the operation of the related art ventilation motor assembly will be explained with reference to FIG. 1. The left and right fans 14 and 24 on the ventilation motor 2 are rotated in the same direction as the ventilation motor 2 is come into operation, to draw air along a shaft direction into the one pair of fan housings 12 and 22 on the same time, and discharge through the air outlet 12*b* in a direction vertical to the direction of air inlet.

The air flow will be described with reference to FIG. 2. When the ventilation motor 2 is put into operation, an exhaust gas from the gas oven range under the microwave oven flows into the microwave oven through an air suction (not shown) in the side of the microwave oven. The exhaust gas then flows toward the one pair of fan housings 12 and 22 on both sides of the ventilation motor 2 through a space formed between a rear wall of the electric fitting room 36 and a rear wall of the microwave oven. The exhaust drawn through the one pair of fan housings 12 and 22 is discharged above the microwave oven through the air outlets 12*b* and 22*b* in the fan housings. In this instance, as the fan housings 12 and 22 are rotatable, different from the drawing, the air outlets 12*b* and 22*b* may face front, or rear of the microwave oven. That is, directions of the exhaust gas discharged by the ventilation motor 2 vary with directions of the fan housings 12 and 22.

However, the related art ventilation motor assembly has the following problems in view of a system.

The related art ventilation motor assembly has an air flow direction toward the ventilation motor 2 only when the ventilation motor 2 is in operation. That is, when the ventilation motor 2 is in operation, the exhaust gas flows into the one pair of the fan housings 12 and 22 on the same time along a shaft direction, and discharged through the air outlet 12*b* in a direction perpendicular to a direction of inlet. Accordingly, the fixed air flow direction in designing suction/discharge structure of the microwave oven in the related art ventilation motor assembly substantially limits air flow structural design, that makes a structure of the electric fitting room complicate. That is, the related art ventilation motor assembly leads to require a separate ventilation system for the electric fitting room, such that cooling down of the electric fittings in the electric fitting room is invariably made by a separate cooling fan, to require a separate air flow passage, that makes an internal structure of the microwave oven complicate.

SUMMARY OF THE INVENTION

Accordingly, the present invention is directed to a ventilation motor assembly in a microwave oven that substantially obviates one or more of the problems due to limitations and disadvantages of the related art.

An object of the present invention is to provide a ventilation motor assembly in a microwave oven, in which a variety of air flows are formed for forming a variety of air suction/discharge structures of the microwave oven.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the structure of a ventilation motor assembly in a microwave oven includes a ventilation motor having first and second shafts fitted in opposite directions, a sirocco fan interlocked with the first shaft for drawing air in a direction of the first shaft and discharging in a direction perpendicular to the first shaft, and a radial fan interlocked with the second shaft for drawing air in a direction perpendicular to the second shaft and discharging in a direction of the second shaft, thereby permitting the sirocco fan and the radial fan to form air flows different from each other when the ventilation motor is in operation, to provide a variety of air suction/discharge structures for ventilation of the microwave oven and a variety of air flow structures for prevention of temperature rise.

It is preferable that a fan housing having an air outlet in an outer surface thereof and an angle of fitting position variable as the fan housing is rotated round the first shaft is provided around the sirocco fan, thereby permitting to direct air discharged from the sirocco fan in a variety of directions by varying a fitting position of the fan housing.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
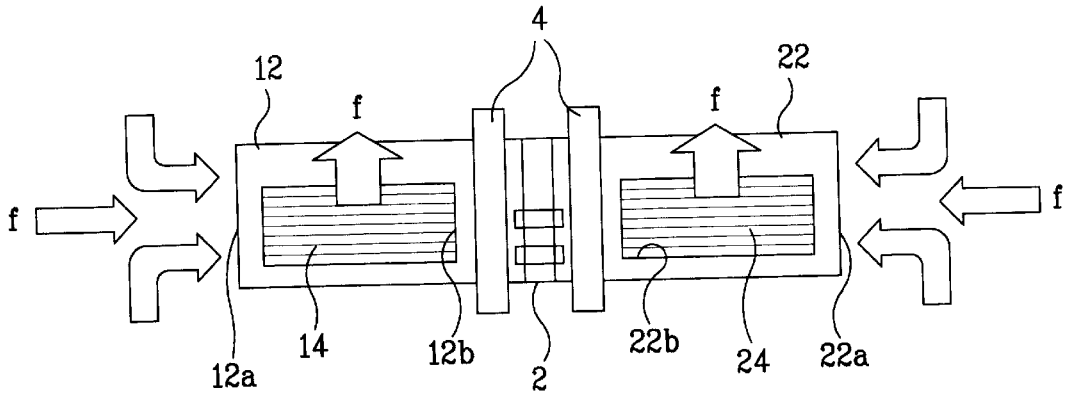
FIG.1 Related Art
FIG. 1 illustrates a front view of a related art ventilation motor assembly.
Figure 2:
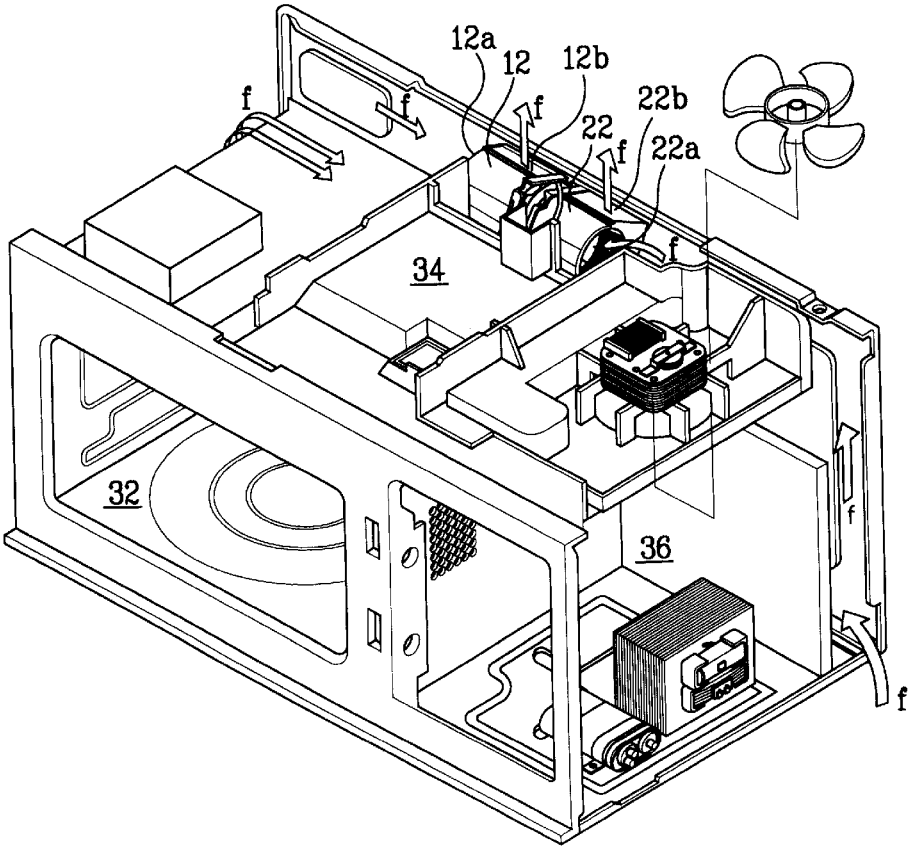
FIG.2 Related Art
FIG. 2 illustrates a perspective view of a microwave oven having a related art ventilation motor fitted thereto.
Figure 3:
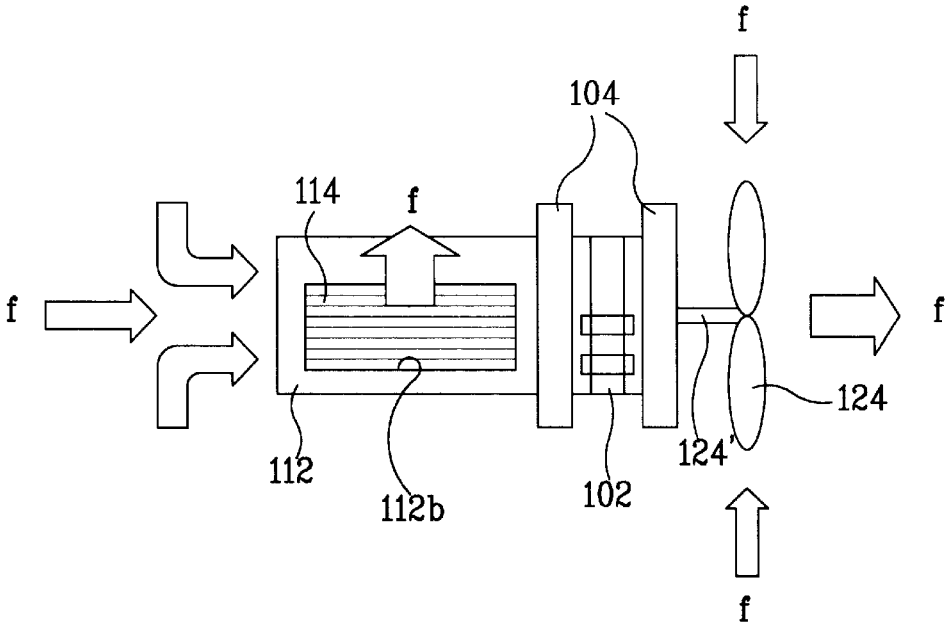
FIG. 3 illustrates a front view of a ventilation motor assembly in accordance with a preferred embodiment of the present invention; and, FIG. 4 illustrates a perspective view of a microwave oven having a ventilation motor assembly of the present invention fitted thereto.

Reference will now be made in detail to the preferred embodiments of the present invention, examples of which are illustrated in the accompanying drawings. FIG. 3 illustrates a front view of a ventilation motor assembly in accordance with a preferred embodiment of the present invention.

Referring to FIG. 3, there is a ventilation motor 102 supported on both sides thereof by supporters 104. The ventilation motor 102 has output shafts at both ends thereof. The shaft at the left is a first shaft, and the shaft at the right is a second shaft 124'. The first shaft is behind the fan housing 112.

There is a radial fan 124 fitted to a fore end of the second shaft 124'. The radial fan 124 has a plurality of blades for drawing air in a direction perpendicular to the second shaft 124' and discharging in a direction of the second shaft 124'. A shape of the radial fan 124 may be varied as far as the radial fan 124 can discharge air in the direction of the second shaft 124'.

There is a sirocco fan 114 at a fore end of the first shaft (not shown). The sirocco fan 114 has a plurality of vanes along a circumferential direction at fixed intervals, for drawing air in a direction of the first shaft and discharging in a direction perpendicular to the first shaft. There is a fan housing 112 around the sirocco fan 114. There is an air outlet **112*b* in an outer circumference of the fan housing 112 for discharging air in a direction perpendicular to the first shaft. The fan housing 112 fitted around the sirocco fan 114 is rotatable round the first shaft. However, the fan housing 112 may be fitted around the sirocco fan 114** in various methods.

Figure 4:
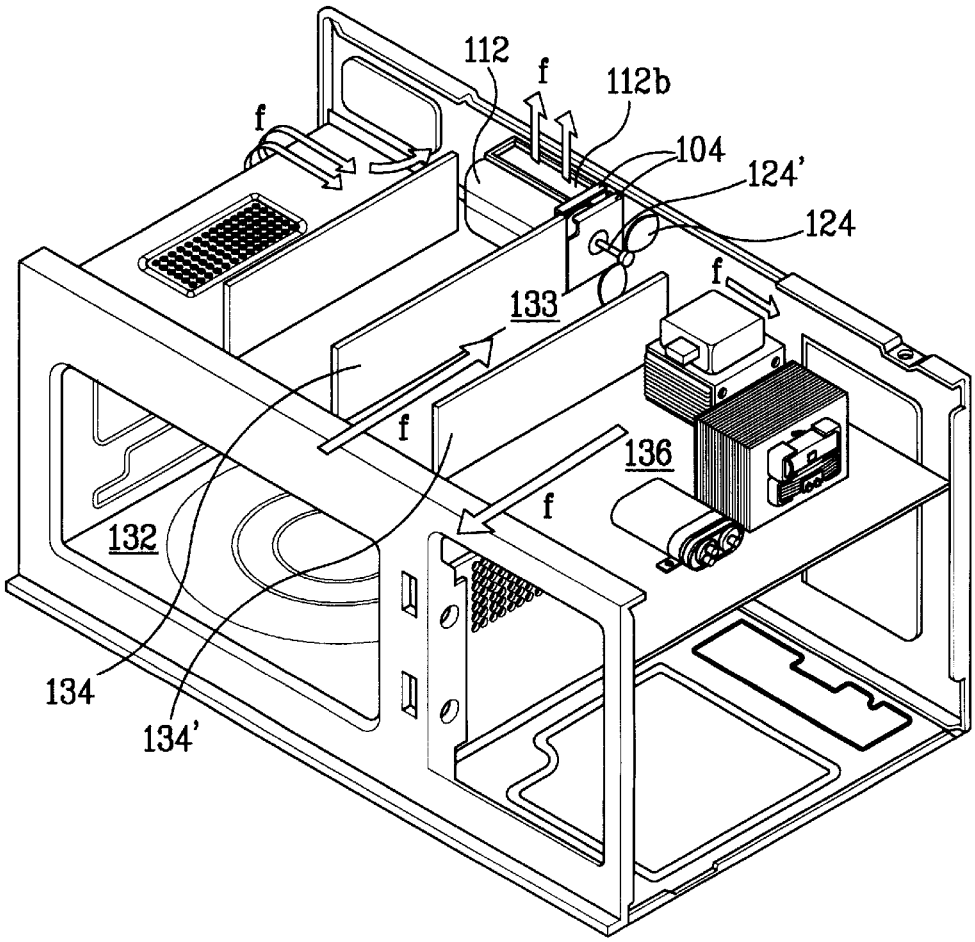

FIG. 4 illustrates a perspective view of a microwave oven having a ventilation motor assembly of the present invention fitted thereto. As shown, the ventilation motor assembly of the present invention is fitted in a rear part of a left guide wall 134 of an air duct 133 on a cavity 132. That is, the ventilation motor assembly is fitted such that the radial fan 124 faces a right side, and sirocco fan 114 faces a left side, with reference to the left guide wall 134 of the air duct 133.

There is an electric fitting room 136 above the cavity 132. That is, a floor of the electric fitting room 136 is provided at a height substantially identical to a height of a top surface of the cavity of the microwave oven, and electric fittings, such as a magnetron, a high voltage transformer, and a high voltage capacitor, are placed thereon.

A right guide wall 134' forming the air duct 133 together with the left guide wall 134 extends from front to rear of the microwave oven, separating the electric fitting room 136 from the air duct 133. The arrows and the 'f' symbols on the drawing indicate air flow formed by the ventilation motor assembly.

The operation of the ventilation motor in accordance with a preferred embodiment of the present invention will be explained, in detail. At first, outline of the air flow caused by the ventilation motor assembly will be explained, with reference to FIG. 3.

Upon putting the ventilation motor 102 having the first and second shafts into operation, the radial fan 124 on the end of the second shaft 124' rotates round the second shaft 124'. The radial fan 124 draws air in a direction perpendicular to the second shaft 124' and discharges in a direction of the second shaft 124'. On the other hand, the sirocco fan 114 fitted to the end of the first shaft (not shown) draws air in a direction of the shaft and discharges in a direction perpendicular to the shaft. Accordingly, as the sirocco fan 114 and the radial fan 124 produce different directions of air inlet/outlet flows, the ventilation motor assembly of the present invention can produce a variety of air flow forms in comparison to the related art ventilation motor assembly.

An air flow process will be discussed in a state the ventilation motor assembly of the present invention is applied to a microwave oven, with reference to FIG. 4.

Upon putting the ventilation motor 102 in rear of an upper surface of the cavity 132 into operation, an air flow from a left of the cavity 132 to the sirocco fan 114 is produced. That is, the sirocco fan 114 draws air from a left side of the cavity 132 toward the first shaft (not shown), and discharges to an upper part of the microwave oven through the air outlet **12*b* in the fan housing 112**. In this instance, the air flow produced by the sirocco fan fitted to the first shaft discharges the heat, smoke, and smell produced from the gas oven range under the microwave oven.

On the other hand, when the radial fan 124 is rotated by the ventilation motor 102, air is drawn through front of the cavity 132. That is, external air flows toward the radial fan 124 through the air duct 133 on the cavity 132. Since the right guide wall 134' of the air duct 133 separates the air duct 133 from the electric fitting room 136, the external air flow by rotation of the radial fan 124 does not enter into the electric fitting room 136, directly. As the external air drawn in a direction perpendicular to the shaft direction when the radial fan 124 is rotated is discharged in a shaft direction, and introduced into the electric fitting room 136, the external air cools down the fittings in the electric fitting room and is discharged to front of the microwave oven, again. That is, the air flow produced by the radial fan 124 on the second shaft 124' discharges heats from the electric fittings, such as the magnetron, the high voltage capacitor, and the high voltage transformer in the electric fitting room, to outside of the microwave oven.

In the meantime, different from the foregoing embodiment, the air duct may also be formed in rear or upper part of the microwave oven if a position of the ventilation motor assembly is changed, because a direction of air inlet of the radial fan 124 may be any direction as far as the direction is perpendicular to the second shaft 124'.

The ventilation motor assembly of the present invention has the following advantages.

Since the sirocco fan on one side of a ventilation motor draws air in a direction of the first shaft of the ventilation motor and discharges in a direction perpendicular to the first shaft, and the radial fan on the other side of the ventilation motor draws air in a direction perpendicular to the second shaft and discharges in a direction of the second shaft, the ventilation motor assembly of the present invention can provide an air suction/discharge structure and an air flow structure for prevention of temperature rise, different from the related art, thereby permitting to design a variety of effective air suction/discharge structures, that allows simplifying an internal structure of the microwave oven, to improve a productivity and reduce cost.

It will be apparent to those skilled in the art that various modifications and variations can be made in the structure of the ventilation motor assembly in a microwave oven of the present invention without departing from the spirit or scope of the invention. Thus, it is intended that the present invention cover the modifications and variations of this invention provided they come within the scope of the appended claims and their equivalents.

What is claimed is:

1. A microwave oven, comprising:

a housing;

a cavity for holding therein items to be heated;

an electric fitting room disposed adjacent to the cavity;

a ventilation motor disposed within the housing adjacent to or within the cavity and having first and second shafts fitted in opposite directions;

a sirocco fan interlocked with the first shaft for drawing air in a direction of the first shaft and discharging air in a direction perpendicular to the first shaft; and a radial fan interlocked with the second shaft for drawing air in a direction perpendicular to the second shaft and discharging air in a direction of the second shaft.

2. The structure as claimed in claim 1, further comprising a fan housing surrounding the sirocco fan having an air outlet in an outer surface thereof, wherein an angle of fitting position is variable as the fan housing is rotated around the first shaft.

3. A microwave oven, comprising:

a housing;

a cavity for holding therein items to be heated;

an electric fitting room disposed adjacent to the cavity;

a ventilation motor fitted to a rear part of an upper surface of the cavity and having first and second shafts fitted thereto and extending in opposite directions;

a sirocco fan interlocked with the first shaft for drawing air in a direction of the first shaft and discharging air in a direction perpendicular to the first shaft;

a radial fan interlocked with the second shaft for drawing air in a direction perpendicular to the second shaft and discharging air in a direction of the second shaft; and an air duct on the upper surface of the cavity for drawing air in a direction perpendicular to the second shaft of the radial fan.

4. The microwave oven as claimed in claim 3, wherein the air duct includes:

a left guide wall that extends from a front to a rear of the microwave oven for separating a sirocco fan side from a radial fan side of the ventilation motor; and a right guide wall that separates the electric fitting room from the air duct.

5. A microwave oven, comprising:

a housing;

a cavity for holding food to be heated disposed within the housing;

an electric fitting compartment having electrical components disposed therein and positioned adjacent to the cavity; and a ventilation motor assembly disposed within the housing and comprising:

a ventilation motor having first and second shafts;

a sirocco fan attached to the first shaft; and a radial fan attached to the second shaft.

6. The microwave of claim 5, wherein the sirocco fan draws air in a direction of the first shaft and discharges air in a direction perpendicular to the first shaft.

7. The microwave oven of claim 5, wherein the radial fan draws air in a direction perpendicular to the second shaft and discharges air in a direction of the second shaft.

8. The microwave oven of claim 7, wherein the electric fitting compartment is in communication with the radial fan such that air discharged passes through the electric fitting room cooling the electrical component disposed therein before passing out of the housing.

9. The microwave oven of claim 7, wherein the electric fitting compartment is positioned at the same height as an upper wall of the cavity.

10. The microwave oven of claim 5, further comprising an air duct disposed above the cavity and extending along an upper surface of an upper wall of the cavity perpendicular to the second shaft, wherein the radial fan draws air in through the air duct and discharges air in a direction of the second shaft, the discharge air passing through the electric fitting compartment before passing out of the housing.

11. The microwave oven of claim 10, wherein the electric fitting compartment is positioned at the same height as an upper wall of the cavity.

12. The microwave oven of claim 5, wherein the ventilation motor assembly is positioned at a rear part of an upper wall of the cavity.

13. The microwave oven of claim 12, wherein the radial fan draws air in a direction perpendicular to the second shaft and discharges air in a direction of the second shaft.

14. The microwave oven of claim 12, wherein the electric fitting compartment is in communication with the radial fan such that air discharged passes through the electric fitting room cooling the electric fittings disposed therein before passing out of the housing.

15. The microwave oven of claim 12, wherein the electric fitting compartment is positioned at the same height as an upper wall of the cavity.

16. The microwave oven of claim 12, further comprising an air duct disposed above the cavity and extending along an upper surface of an upper wall of the cavity perpendicular to the second shaft, wherein the radial fan draws air in through the air duct and discharges air in a direction of the second shaft, the discharge air passing through the electric fitting compartment before passing out of the housing.

17. The microwave oven of claim 5, further comprising an air duct disposed in the housing through which the radial fan draws in air.

18. The microwave oven of claim 17, wherein the air duct comprises:

a first guide wall configured to separate a sirocco fan side of the ventilation motor assembly from a radial fan side of the ventilation motor assembly; and a second guide wall configured to separate the air duct from the electric fitting compartment.

19. The microwave oven of claim 5, further comprising a fan housing disposed around the sirocco fan having an air outlet, a position of the air outlet being variable by rotation of the fan housing around the first shaft.

* * * * *